US011009016B2

(12) United States Patent
Davids

(10) Patent No.: US 11,009,016 B2
(45) Date of Patent: May 18, 2021

(54) DOUBLE ACTING POSITIVE DISPLACEMENT FLUID PUMP

(71) Applicant: Oldenamp B.V., Emmen (NL)

(72) Inventor: Hendrik Berend Davids, Emmen (NL)

(73) Assignee: Oldenamp B.V., Emmen (NL)

( * ) Notice: Subject to any disclaimer, the term of this patent is extended or adjusted under 35 U.S.C. 154(b) by 171 days.

(21) Appl. No.: 16/304,438

(22) PCT Filed: May 23, 2017

(86) PCT No.: PCT/NL2017/050325

§ 371 (c)(1),
(2) Date: Nov. 26, 2018

(87) PCT Pub. No.: WO2017/204631

PCT Pub. Date: Nov. 30, 2017

(65) Prior Publication Data

US 2019/0145391 A1 May 16, 2019

(30) Foreign Application Priority Data

May 26, 2016 (NL) ..... 2016835

(51) Int. Cl.
*F04B 49/20* (2006.01)
*F04B 53/10* (2006.01)
(Continued)

(52) U.S. Cl.
CPC ..... *F04B 5/00* (2013.01); *F04B 1/12* (2013.01); *F04B 19/22* (2013.01); *F04B 49/20* (2013.01);
(Continued)

(58) Field of Classification Search
CPC ..... F04B 1/12; F04B 5/00; F04B 9/00; F04B 53/02
See application file for complete search history.

(56) References Cited

U.S. PATENT DOCUMENTS 2,444,912 A 7/1948 Bodine, Jr.
3,330,217 A * 7/1967 Baur ..... F04B 5/00 417/454
(Continued)

FOREIGN PATENT DOCUMENTS

EP 1 873 349 A1 1/2008
WO 00/50774 A1 8/2000

OTHER PUBLICATIONS

Oct. 13, 2017—International Search Report—PCT/NL2017/050325.

*Primary Examiner* — Bryan M Lettman
*Assistant Examiner* — Timothy P Solak
(74) *Attorney, Agent, or Firm* — Banner & Witcoff, Ltd.

(57) ABSTRACT

Double acting positive displacement fluid pump Double acting positive displacement fluid pump having two or more housings (3A,20A), a first housing (3A) comprising a pump fluid inlet chamber (3) and a separate housing (20A) comprising a pump fluid outlet chamber (20), the pump fluid inlet chamber (3) being in fluid communication with the pump fluid outlet chamber (20) by means of a through passage (6A), said through passage (6A) having an inlet positioned within the pump fluid inlet chamber (3) and an outlet positioned within the pump fluid outlet chamber (20), the inlet portion (6) of the plunger having an effective displacement area which is larger than the effective displacement area of the outlet portion (21) of the plunger, said passage being further provided with a combined suction-discharge valve assembly (9) arranged in the through passage, wherein the pump fluid inlet chamber (3) comprises a central pump fluid inlet chamber axis and a fluid entry (1B) having an inlet suction valve assembly (2), the pump fluid outlet chamber (20) comprises a central pump fluid outlet chamber axis and the through passage comprises a through passage axis, wherein the central pump fluid inlet chamber
(Continued)

axis, the central pump fluid outlet chamber axis and the through passage axis are coaxial and form a central double acting positive displacement fluid pump axis.

9 Claims, 8 Drawing Sheets

(51) Int. Cl.

| | |
|---|---|
| ***F04B 5/02*** | (2006.01) |
| ***F04B 5/00*** | (2006.01) |
| ***F04B 1/12*** | (2020.01) |
| ***F04B 19/22*** | (2006.01) |
| *F04B 47/02* | (2006.01) |
| *F04B 49/06* | (2006.01) |

(52) U.S. Cl.
CPC ..... *F04B 5/02* (2013.01); *F04B 47/02* (2013.01); *F04B 49/065* (2013.01); *F04B 53/10* (2013.01)

(56) References Cited

U.S. PATENT DOCUMENTS

| | | | | |
|---|---|---|---|---|
| 3,986,728 | A * | 10/1976 | Marsh | F16L 1/26 285/18 |
| 4,081,111 | A * | 3/1978 | Sandow | B05B 11/3001 222/309 |
| 4,273,520 | A * | 6/1981 | Sutliff | F04B 47/02 417/434 |
| 4,276,003 | A * | 6/1981 | Perkins | E21B 21/01 184/24 |
| 4,621,987 | A | 11/1986 | Spingath, Jr. | |
| 4,968,226 | A | 11/1990 | Brewer | |
| 5,505,258 | A | 4/1996 | Muth | |
| 8,550,794 | B2 | 10/2013 | Du | |
| 2005/0042111 | A1* | 2/2005 | Zaiser | F04B 25/005 417/225 |
| 2006/0159555 | A1* | 7/2006 | Inoue | F04B 1/0408 417/297 |
| 2013/0287611 | A1* | 10/2013 | Schmidt | F04B 25/02 417/443 |
| 2014/0178210 | A1* | 6/2014 | Bradford, Jr. | F04B 53/10 417/53 |

* cited by examiner

DOUBLE ACTING POSITIVE DISPLACEMENT FLUID PUMP

CROSS-REFERENCE TO RELATED APPLICATIONS

This application is a U.S. National Stage application under 35 U.S.C. § 371 of International Application PCT/NL2017/050325 (published as WO 2017/204631 A1), filed May 23, 2017, which claims the benefit of priority to Application NL 2016835, filed May 26, 2016. Benefit of the filing date of each of these prior applications is hereby claimed. Each of these prior applications is hereby incorporated by reference in its entirety.

BACKGROUND OF THE INVENTION

Field of the Invention

The invention relates to a double acting positive displacement fluid pump.

Background of the Invention

In general the present invention relates to high pressure reciprocating pumps which are used in for example the oil and gas industry for pumping drilling mud, pumping cement for zonal isolation, pumping fracturing fluids and chemical compositions for production enhancement purposes and pumping cryogenic fluids like liquid nitrogen and liquid $CO_2$. High pressure reciprocating pumps are also in the field of industrial services for inter alia water jetting and cleaning purposes.

These reciprocating pumps can be of a piston type pump or a plunger type pump where a plunger pump is defined as a type of positive displacement pump where the high-pressure seal is stationary and a smooth cylindrical plunger slides through the seal and a piston pump is a type of positive displacement pump where the high-pressure seal reciprocates with the piston. For all intents and purposes in this disclosure the terms piston or plunger can be used interchangeable.

Most of these pumps are based on the principle of transferring rotational movement to linear movement of the piston or plunger by means of a crankshaft to reciprocate a piston or plunger.

One of the main disadvantages of such reciprocating pumps is that the pump chamber also called "fluid-end" is subject to pressure cycling i.e. a suction stroke at close to atmospheric pressure followed by a discharge stroke at line discharge pressure. These pressure cycles cause metal fatigue in the body of the fluid-end resulting in a shortened life span and subsequent failures with associated risk and high cost. The resulting metal fatigue is a function of the quantity of pressure cycles and the pressure differential between cycles. At higher pressure differentials fatigue develops exponential. Especially in today's oil and gas industry where hydrocarbon well stimulation operations are done one on a 24/7 basis the average running time for a pump operating at pressures around or in excess of 10000 psi has more than quadrupled compared to conventional oil and gas operations and fatigue of a fluid-end has become a major cost, risk and downtime factor. During these hydrocarbon well stimulation operations fluids containing low to high concentrations of particles like sand or man-made proppant are pumped at high rates (up to 100 BPM or more and high pressures up to 10000 psi or more). Fluid-ends used in such pumps are mostly 3 (Triplex) or 5 plunger (Quintuplex) pumps with a "T" shaped configuration with a horizontal bore with a suction/discharge chamber wherein the piston or plunger reciprocates and a vertical bore with suction and discharge valve arrangements. The pressure cycling of such fluid end causes metal fatigue mainly in the areas where the vertical bore intercepts with the horizontal bore. Other areas where the internal surface of the fluid end is not flush like valve retainer grooves are also prone to stress cracking.

Another disadvantage often seen when using crankshaft driven reciprocating pumps is that instantaneous flow rate can vary substantially. These varying flow rates tend to produce undesirable pressure spikes also called "noise" in the pumped fluid which can cause cavitation and premature wear in the fluid end or interfere with downhole wireless data transmission and other techniques used, for instance measurement while drilling (MWD) or logging while drilling (LWD) operations.

A further disadvantage of known reciprocating high pressure fluid pumps is that maintenance is often cumbersome as e.g. valves and valve seats are difficult to access and in case of a pump section failure, it requires the whole pump to be taken offline leading to substantial loss in pumping volume.

In addition, in some prior art double acting fluid pumps, such as for example described in U.S. Pat. No. 8,550,794, one discharge stroke depends on spring force to overcome the pressure while a solenoid stroke must overcome the spring force as well as the force exerted by pressure. Since output rate and output pressure are predetermined and defined by the solenoid force and spring force during operation of the pump the output rate and pressure cannot be manipulated as is nowadays desired in many positive displacement pumping applications. Another disadvantage of spring force dependent double acting fluid pumps is that spring force is not linear and therefore the output rate and pressure are also not linear. Other distinctive attributes of such prior art double acting pumps is that they have a single housing which is divided by one piston with piston seals acting in both directions. To be functional these internal seals require smooth internal walls of the pressure chamber. Abrasive and/or corrosive fluids and/or slurries will deteriorate the inner wall surface and seals quickly. Another disadvantage of internally sealed pistons is that piston seal failures occur internally and can go unnoticed eroding the internal walls and piston quickly beyond repair, especially with many pumps operating online simultaneously as is the case in well stimulation activities it will be hard to detect which pump has a seal failure. Due to the shape of these pressure chambers there will also be dead spots where solid particles can accumulate and lock-up the spring or piston reducing the efficiency of the pump as it is spring force dependent.

SUMMARY OF THE INVENTION

It is an object of the invention to provide an alternative double acting fluid pump. It is a further object of the invention to provide a double acting positive displacement fluid pump that can handle normal fluids and gasses as well as fluids, gasses and slurries containing low to high contents of solids with an abrasive and/or corrosive nature over a wide range of pressures which double acting positive displacement fluid pump displays one or more of the following features: is far less susceptible to fatigue failure, has only one suction stroke, can have a much longer pump stroke compared to conventional pumps, has an improved packing and valve life and provides double the output of a conventional reciprocating pump with substantial lesser pressure pulsations, is easy to maintain and which output can also easily be manipulated during operation of the pump.

According to the invention at least one of the objects described above is obtained by providing a double acting positive displacement fluid pump according to claim 1. According to the invention a double acting positive displacement fluid pump has a first housing comprising a pump fluid inlet chamber and a second separate housing comprising a pump fluid outlet chamber. The pump fluid inlet chamber being in fluid communication through a passage with the pump fluid outlet chamber. Said through passage being further provided with at least one combined suction-discharge valve arranged in the through passage, said through passage having an inlet positioned within the pump fluid inlet chamber and an outlet positioned within the pump fluid outlet chamber, the reciprocatingly drivable plunger having one side reciprocatingly positioned within the pump fluid inlet chamber hereinafter called inlet portion and the other side reciprocatingly positioned within the pump fluid outlet chamber hereinafter called outlet portion, the inlet portion of the plunger having an effective displacement area which is larger than the effective displacement area of the outlet portion wherein the pump fluid inlet chamber and inlet portion comprises a central pump fluid inlet chamber axis and a fluid entry having an inlet suction valve assembly, the pump fluid outlet chamber and outlet portion comprises a central pump fluid outlet chamber axis and the drive shaft comprises a drive shaft axis, wherein the central pump fluid inlet chamber axis, the central pump fluid outlet chamber axis and the drive shaft axis are coaxial and form a central double acting positive displacement fluid pump axis. The inlet portion effective displacement area of the plunger is larger than the outlet portion effective displacement area of the plunger and the displacement volume of the inlet portion of the plunger is preferably twice the displacement volume of the outlet portion of the plunger, whereby the dimensioning of the respective chambers is such that the dead volumes in the inlet and outlet chambers are minimized in order to prevent settling of particles and provide maximum velocity of the fluid. The inlet chamber and outlet chamber each have separate sealing arrangements where the sealing between the chamber and its reciprocating plunger takes place by a plunger sealing arrangement which withstands internal pressure from within its respective chamber to the outside of the pump body. Please note that although a first and a second housing are described the invention is not limited to a double acting positive displacement fluid pump having only two housings, but that the pump can comprise also more than two housings.

In accordance with the invention at the discharge stroke of the inlet portion of the plunger (i.e. the stroke decreasing the volume of the pump fluid inlet chamber) the inlet suction valve assembly closes, the fluid, gas or slurry is forced from the inlet chamber through the through passage, opening the combined suction/discharge valve, into the pump fluid outlet chamber. The discharge stroke of the inlet portion provides that the capacity of the pump fluid outlet chamber increases on the discharge stroke of the inlet portion. As the inlet portion of the plunger displaces preferably twice the volume of the outlet portion simultaneously pressurized filling for the pump fluid outlet chamber with one half of the fluid displaced by the inlet portion and displacement of the other half of the fluid outside of the pump fluid outlet chamber for its intended use takes place. The pressure of the fluid with which the pump fluid outlet chamber is filled thus equals the line pressure (line pressure is the pressure on the discharge line from the double acting pump to e.g. a wellhead or any other body requiring fluid to be pumped in, to or pumped through) thus preventing pressure cycles from occurring as a result of which metal fatigue in the pump fluid outlet chamber is greatly reduced. With the combined suction/discharge valve in open position during the compression stroke of the inlet portion the one half of the fluid providing pressurized fill for the outlet chamber is (substantial) pressure balanced across the relative displacement areas of the inlet and outlet portion and therefor it requires limited power to transfer this portion of the fluid from the inlet chamber to the outlet chamber. The pump fluid outlet chamber is always pressurized when the pump is in operation either by a pressure accumulator for i.e. a single section of a pump or by a i.e. Triplex or Quintuplex pump neighboring section's outlet portion discharge stroke, whereby the pressure in the outlet chamber is either equal or larger than the pressure in the inlet chamber which is beneficial that at the start of the compression stroke of the inlet portion with the combined suction/discharge valve still in closed position, the pressure acting in the pump outlet chamber and thus across the total effective area of the outlet portion will counteract on half of the effective area of the inlet portion until the pressure in the inlet chamber equals the pressure in the outlet chamber and the combined suction/discharge valve opens. At that point the effective area of the outlet portion balances with half of the effective area of the inlet portion. This results in that the force required for the inlet portion compression stroke equals the force for the outlet portion compression stroke which is only half of the force on the drive mechanism for the same output volume in comparison with a single acting reciprocating pump.

To take account of the situation that prime could be lost on the side of the pump fluid inlet chamber or to take account of a possible packing failure it is advantageous to have a check valve either at the fluid exit end of multiple pump sections i.e. a triplex or quintuplex pump or have a check valve situated at the entry point of a common manifold where multiple pump-units discharge into.

In a further embodiment of a double acting positive displacement fluid pump according to the invention the pump fluid inlet chamber is in fluid communication with the pump fluid outlet chamber by means of a reciprocatingly drivable hollow plunger having a through passage, said hollow plunger having an inlet portion reciprocatingly positioned within the pump fluid inlet chamber and an outlet portion reciprocatingly positioned within the pump fluid outlet chamber, the inlet portion of the hollow plunger having an effective displacement area which is larger than the effective displacement area of the outlet portion of the hollow plunger, said hollow plunger being further provided with at least one combined suction-discharge valve arranged in the through passage, wherein the pump fluid inlet chamber and inlet portion comprises a central pump fluid inlet chamber axis and a fluid entry having an inlet suction valve assembly, the pump fluid outlet chamber comprises a central pump fluid outlet chamber and outlet portion axis and the through passage comprises a through passage axis, wherein the central pump fluid inlet chamber axis, the central pump fluid outlet chamber axis and the through passage axis are coaxial and form a central double acting fluid pump axis.

In a still further embodiment of a double acting positive displacement fluid pump according to the invention the pump fluid outlet chamber comprises a pressure accumulator and a check valve where the accumulator provides the pressure-assist to initiate the discharge stroke of the inlet portion.

In an embodiment of a double acting positive displacement fluid pump according to the invention the pump fluid inlet chamber comprises a fluid entry having a fluid entry axis which is coaxial with the central double acting positive displacement fluid pump axis whereby sections of the fluid end that are subject to pressure fluctuations during suction and discharge strokes and thereby prone to fatigue stress cracking are internally cylindrical and flush in shape with no perpendicular penetrations, grooves or other cross-bores thus providing more equal stress patterns and greatly reducing fatigue.

In a further embodiment of a double acting positive displacement fluid pump according to the invention the double acting positive displacement fluid pump comprises a hollow plunger with a conical bore acting as a diffuser to reduce turbulence of the fluid and reduce wear and erosion of the pump chamber and inner hollow bore of the plunger. This further provides a beneficial reduction in weight of the inlet and outlet portion.

In an even further embodiment of a double acting positive displacement fluid pump according to the invention the hollow plunger comprises beveled plunger ends in which plunger openings are provided. By the beveled, open ended hollow plunger the problem of packing of settled solid particles ahead of the plunger ends is at least reduced as the plunger ends do not provide flat surfaces on which settled solid particles can get jammed between the inner end surfaces of the fluid chambers and the hollow plunger as can be the case with conventional reciprocating plunger pumps.

In a further embodiment of a double acting positive displacement fluid pump according to the invention the housing is composed of a first housing comprising the pump fluid inlet chamber and a second housing, separate from the first housing, said second housing comprising the pump fluid outlet chamber.

In a further embodiment of a double acting positive displacement fluid pump according to the invention the pump fluid inlet chamber of the first housing and the pump fluid outlet chamber of the second housing are cylindrical in shape.

In a further embodiment of a double acting positive displacement fluid pump the inlet chamber of the first housing then has an inlet chamber head end, the outlet chamber of the second housing has one or more housing head ends, and a drive mechanism which has a housing head end and wherein or between the housing head ends a packing and hydraulic packing adjustment device is arranged, said hydraulic packing adjustment device comprising at least one hydraulic cylinder being arranged parallel to the plunger. The hydraulic packing adjustment device can provide a constant but remotely adjustable force on the packing rings leading to a prolonged life span of the double acting positive displacement fluid pump packing and less downtime for maintenance. The hydraulic packing adjustment device preferably further comprises a packing arrangement seal assembly comprising a packing gland, a wear sleeve, packing rings and a lubrication device. In addition, since the hydraulic packing adjustment device is arranged between the housings and thus is externally accessible it can easily be inserted and retracted as a whole thereby reducing the downtime for repair and maintenance.

In a further embodiment of a double acting positive displacement fluid pump according to the invention in which the double acting positive displacement fluid pump comprises a plunger drive for reciprocating the plunger it is then advantageous when the double acting positive displacement fluid pump comprises a controller for controlling and monitoring of the operation of the plunger drive and the operation and monitoring of at least one hydraulic cylinder. By using the controller the force exerted by the hydraulic cylinder can easily and for safety reasons more importantly remotely be adjusted e.g. to match with the force exerted by the pumped fluid discharge pressure. In addition, when the double acting positive displacement fluid pump is not in use the packing seal arrangement can be set in a relaxed position by removing the hydraulic pressure from the cylinder(s) thus providing longer packing life.

DETAILED DESCRIPTION OF THE INVENTION

Figure 1A:
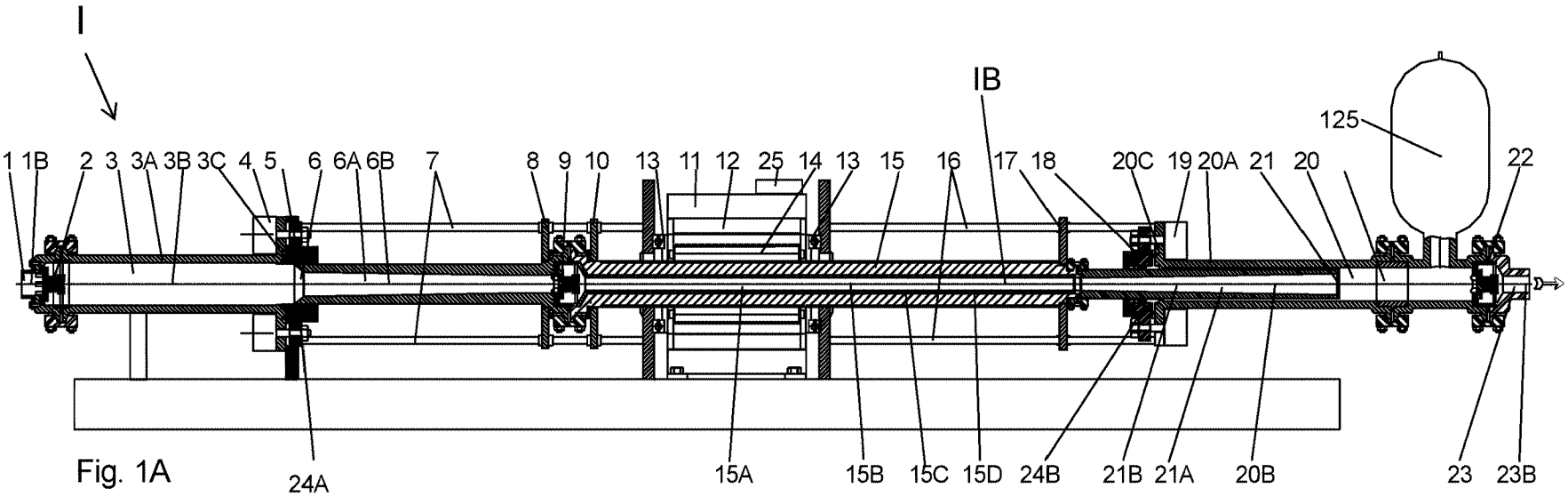
In FIG. 1A a first embodiment of a double acting positive displacement fluid pump in accordance with the invention driven by a hollow shaft electric torque motor is schematically shown in cross section.

The double acting positive displacement fluid pump I shown in FIG. 1A has a first housing 3A comprising a cylindrical pump fluid inlet chamber 3, and a second housing 20A, separate from the first housing 3A, comprising a cylindrical pump fluid outlet chamber 20.

The pump fluid inlet chamber 3 is in fluid communication with the pump fluid outlet chamber 20 by means of a reciprocatingly drivable hollow plunger 6, 15, 21 having a through passage 6A, 15A, 21A. The hollow plunger has an inlet portion 6 positioned within the pump fluid inlet chamber 3 and an outlet portion 21 positioned within the pump fluid outlet chamber 20. The inlet portion 6 and the outlet portion 21 of the hollow plunger are connected to each other via a hollow screw shaft 15. The inlet portion 6 of the hollow plunger has an outside diameter which is larger than the outside diameter of the outlet portion 21 of the hollow plunger.

Figure 1B:
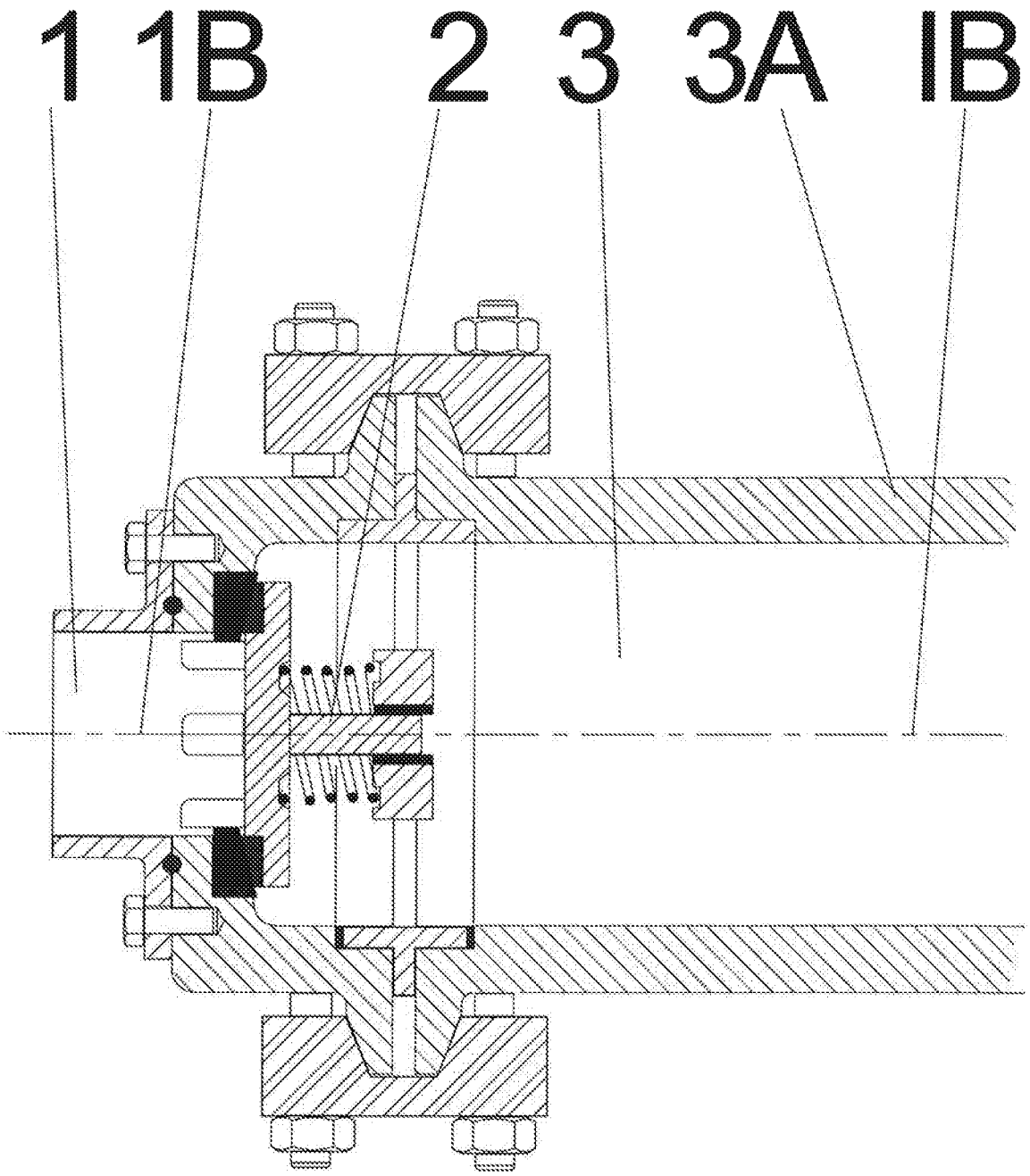
FIG. 1B shows the inlet suction valve assembly thereof in an enlarged view.
Figure 1C:
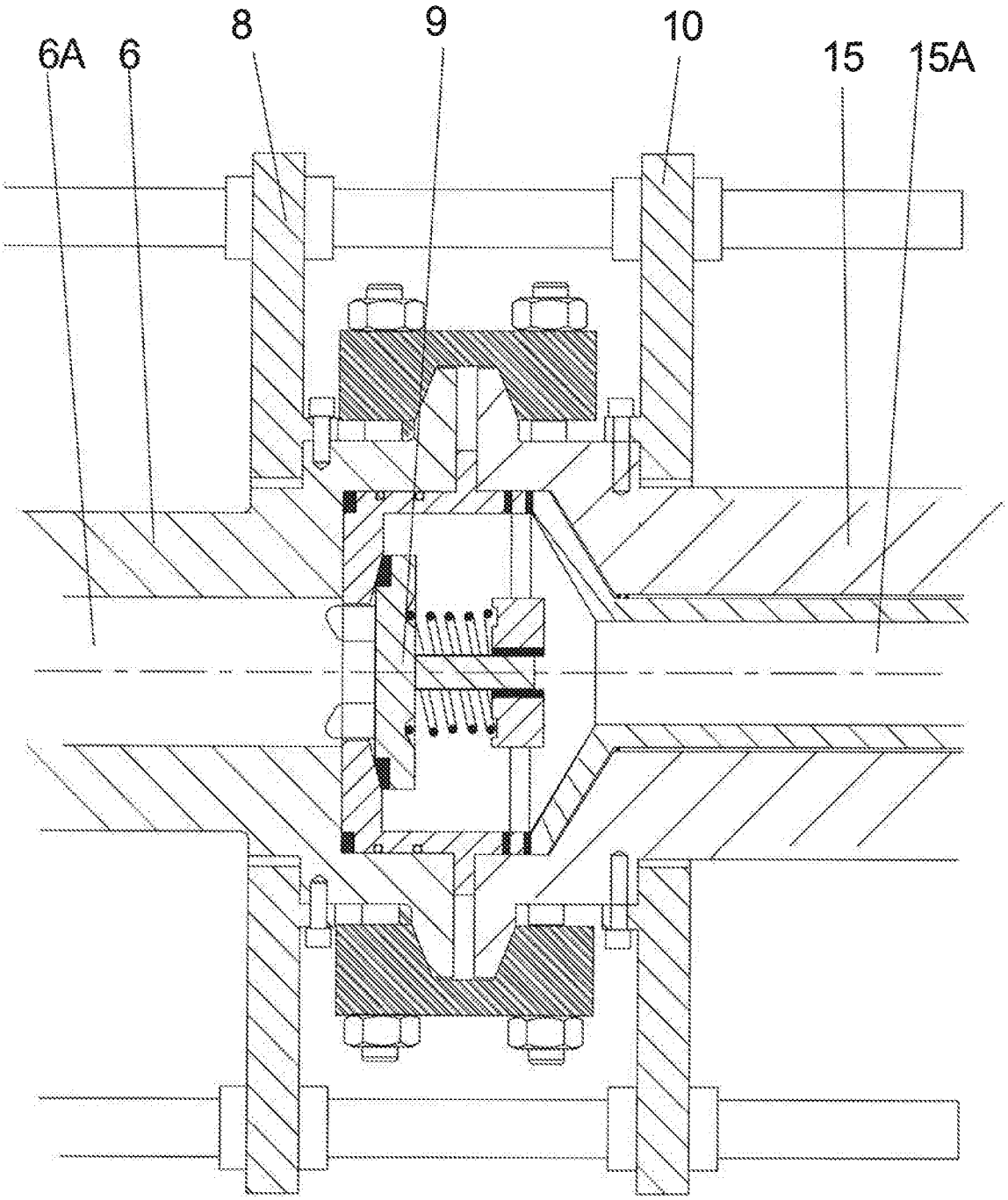
FIG. 1C shows the combined suction-discharge valve thereof in an enlarged view.

The hollow plunger 6, 15, 21 is further provided with a combined suction-discharge valve and seal assembly 9 arranged in the through passage, in the shown embodiment on the intersection between the inlet portion 6 and the hollow screw shaft 15 (see also FIG. 1C).

The pump fluid inlet chamber 3 comprises a central pump fluid inlet chamber axis 3B and a fluid entry 1 having an inlet suction valve and seal assembly 2 (in more detail shown in FIG. 1B). The pump fluid outlet chamber 20 comprises a central pump fluid outlet chamber axis 20B and the through passage 6A, 15A, 21A comprises a through passage axis 6B, 15B, 21B. The double acting positive displacement fluid pump I is constructed such that the central pump fluid inlet chamber axis 3B, the central pump fluid outlet chamber axis 20B and the through passage axis 6B, 15B, 21B are coaxial and together form a central double acting positive displacement fluid pump axis IB.

In the shown embodiment the diameter of the pump fluid inlet chamber 3 is larger than the diameter of the pump fluid outlet chamber 20 with an amount such that in combination with the dimensioning of the inlet portion 6 and the outlet portion 21 of the hollow plunger the displacement volume of the inlet portion 6 of the hollow plunger is twice the displacement volume of the outlet portion 21 of the hollow plunger.

Figure 1D:
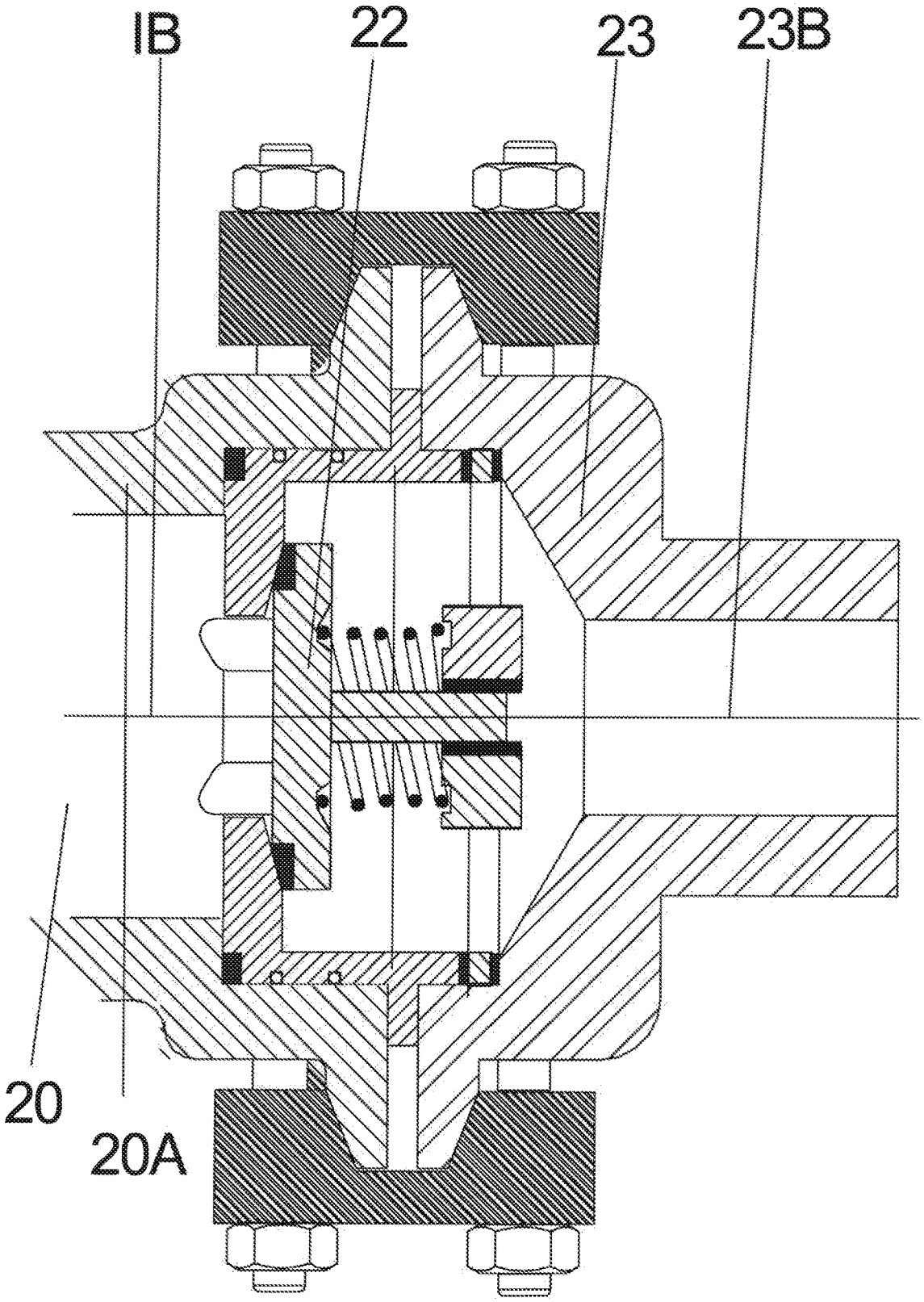
FIG. 1D shows the outlet discharge valve assembly thereof in an enlarged view.
Figure 1E:
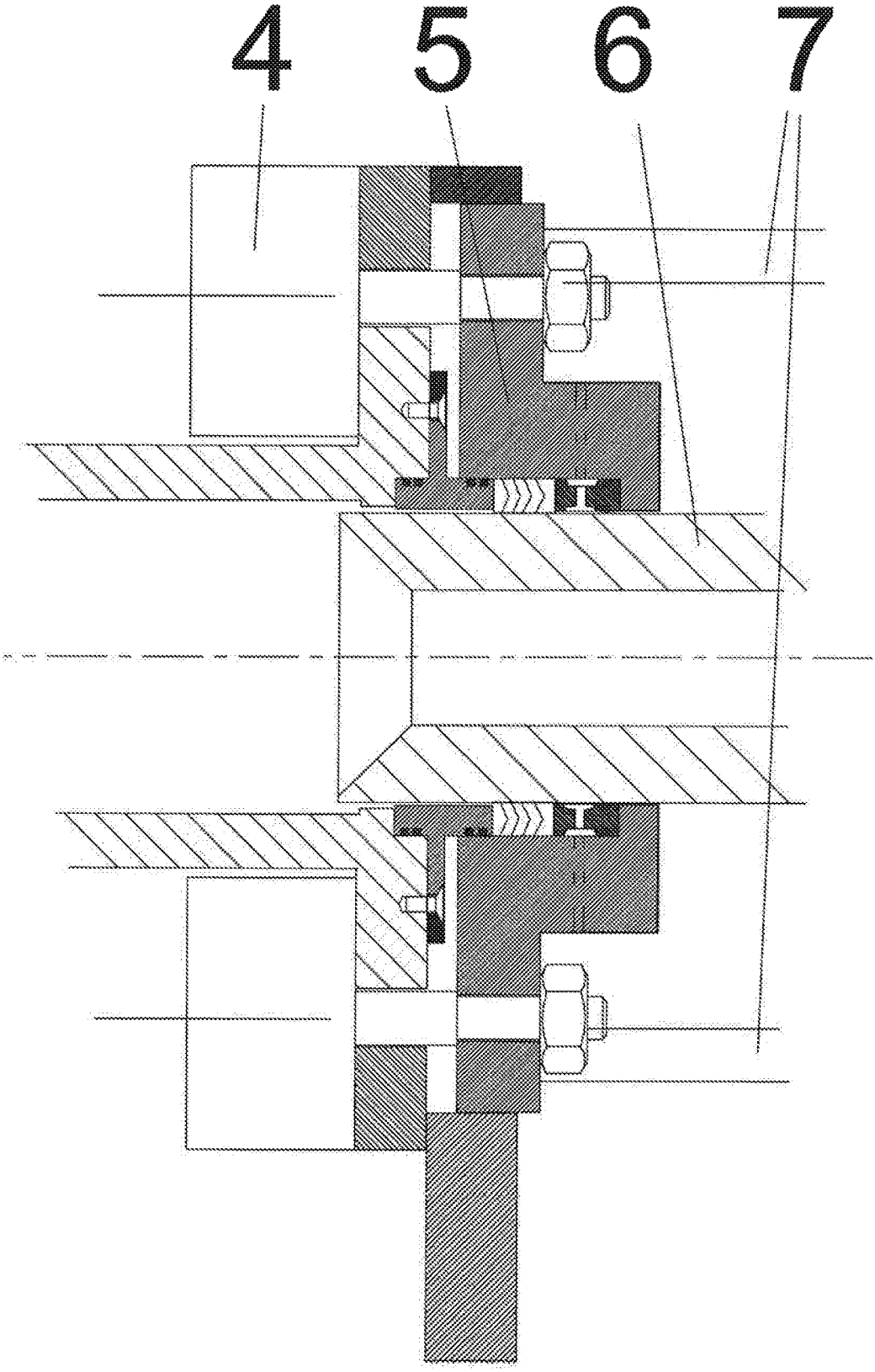
FIG. 1E shows the hydraulic packing arrangement thereof in an enlarged view.

In the shown embodiment the fluid entry 1 of the pump fluid inlet chamber 3 has a fluid entry axis 1B which is coaxial with the central double acting positive displacement fluid pump axis IB (see FIG. 1B) and also a fluid outlet 23 of the pump fluid outlet chamber 20 has a fluid outlet axis 23B which is coaxial with the central double acting positive displacement fluid pump axis IB (see FIG. 1D). In the fluid outlet a pressure accumulator 125 of sufficient capacity and a discharge valve and seal assembly 22 is arranged.

As is shown in FIG. 1A between a first housing head end 3C and a second housing head end 20C a hydraulic packing adjustment device 24A, 24B is arranged, said hydraulic packing adjustment device comprising at least one hydraulic cylinder or actuator 4, 19. The hydraulic packing adjustment device 24A, 24B further comprises a packing gland arrangement module 5 for the inlet plunger portion 6, and a packing arrangement module 18 for the outlet plunger portion 21.

The double acting positive displacement fluid pump I comprises a hollow plunger drive 11, 12, 13, and 14 for reciprocating the hollow plunger 6, 15, 21. In the shown embodiment the hollow plunger drive comprises a stator 11 of an electric motor, a rotor 12 of the electric motor, a bearing arrangement 13 and a screw roller mechanism 14 for engaging the hollow screw shaft 15. The double acting positive displacement fluid pump I further comprises a controller 25 (schematically shown) for controlling the operation of the hollow plunger drive and the operation of the hydraulic cylinders or actuators.

Figure 1F:
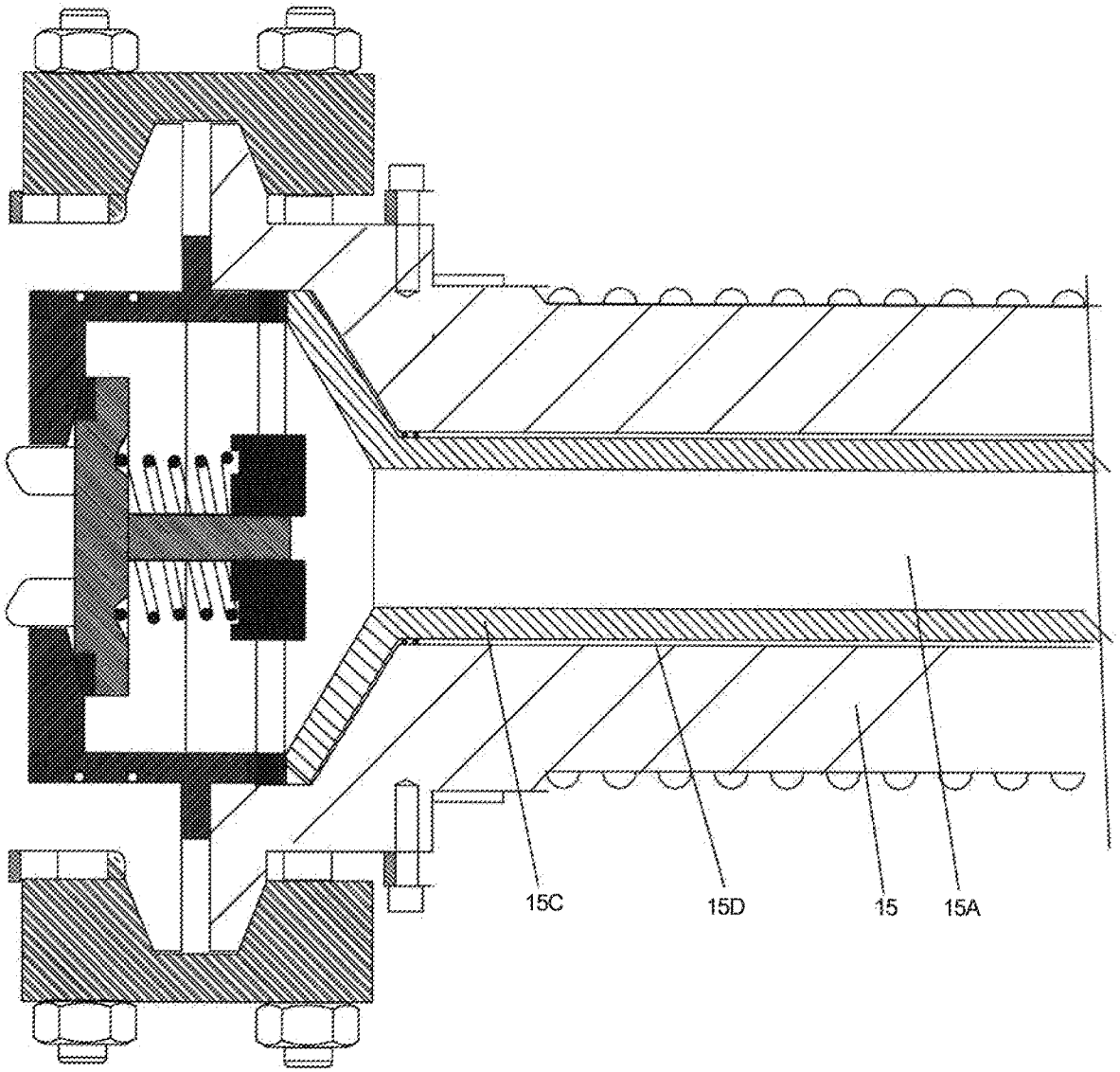
FIG. 1F shows a second fluid conduit inside the bore of the screw shaft.

In this first embodiment the reciprocation or propulsion of the hollow plunger is achieved by means of a planetary roller screw drive mechanism 11-14. The screw shaft 15 with a matching pattern to the pattern of the drive mechanism 14 can be one integral part, however to compensate for expansion of the hollow shaft 15 by the internal pressure of the through passage 15A which could interfere with the clearance precision and proper functioning of the roller screw mechanism 14 a second fluid conduit 15C can be fitted inside the bore of the screw shaft 15 with ample clearance 15D between the screw shaft 15 and fluid conduit 15C to allow expansion of the conduit 15C which is sealed at both ends to prevent pressure entering the clearance 15D (see FIG. 1F).

The through passage 6A, 15A, 21A from the inlet plunger portion 6 to the outlet plunger portion 21 provides the fluid communication or connection via the internal passage 15A of the hollow screw shaft 15. In addition the pumped medium passing through the through passage, in particular the passage 15A provides cooling to the drive mechanism 11-14.

When the drive 11-14 is engaged in right hand rotation for a right hand roller screw mechanism 14 viewed from the fluid inlet side 1, the hollow plunger 6, 15, 21 will move towards the pump fluid inlet side 1 and displace the fluid out of the inlet chamber 3 where half of the fluid is displaced at line discharge pressure into the outlet pump chamber 20 and the other half out of the double acting positive displacement fluid pump I for its intended use. When the end of the normal stroke is reached the direction of the drive is changed to left hand rotation and the hollow plunger 6, 15, 21 will move towards the outlet side 23 of the double acting positive displacement fluid pump I simultaneously closing the suction/discharge valve 9, providing a suction stroke for the inlet plunger portion 6 and a discharge stroke of the outlet plunger portion 21. At the end of the discharge stroke of the outlet plunger portion 21 the rotation is reversed again and the cycle repeats. At this point the pressure in the outlet chamber 20 and the accumulator 125 assists in initiating the discharge stroke of the inlet portion 6.

The hollow plunger 6, 15, 21 and screw shaft 15 is supported by bracket 8, 10 and 17 which are suspended by guide shafts 7 and 16 whereby brackets 10 and 17 also provide anti-rotation of the screw shaft 15.

The controller 25 controls the operation of the drive 11-14 and i.e. governs the speed, torque and change of direction of the drive. The controller 25 in particular controls the speed for the following steps during a cycle: the pre-compression stroke of the inlet portion 6, the RPM acceleration time, the discharge stroke of the inlet portion 6, the RPM deceleration time, stopping of the drive and change of direction, the RPM acceleration time of the outlet portion 21, the discharge stroke of the outlet portion 21. The controller 25 can in particular track pump and motor parameters, e.g. the position of the screw shaft 15 and the amount of revolutions of the drive mechanism 14 to reach full pre-compression and adjusts the number of pre-compression revolutions as and when required. In a further embodiment of the invention the double acting positive displacement fluid pump I can comprise sensors for measuring the fluid pressure and (backup) sensors and encoders for controlling the screw shaft 15 end positions e.g. for normal operations and maintenance positions.

These sensors and encoders are connected to the controller 25 which receives the measurements results and can initiate appropriate actions as and when required e.g. reverse rotation, shut down when a measured pressure drop below a given threshold at the inlet 1 is occurring, which potentially could mean losing prime on the pump or shut down when a measured pressure exceeds a given threshold (so called pressure kick-out).

The controller will also record certain parameters of the pump and motor such as but not limited to pressures and amount of cycles in order to predict preventative maintenance on the screw drive mechanism and packing The stroke length of the drive screw shaft 15 can further be such that beyond the normal operating pump cycle it has additional stroke each way so that the plunger can be retracted from the fluid end and packing arrangement 24A, 24B and the packing arrangement can be replaced without any further disassembly of the fluid end thus greatly reducing the effort, downtime and man-hours for maintenance.

Please note that the hollow plunger drive of the double acting positive displacement fluid pump is not restricted to the drive as shown in the first embodiment. It is to be understood that the drive mechanism can be of any other known type, such as a ball type screw drive, recirculating ball screw drive, roller screw drive or planetary roller screw drive, recirculating roller screw drive, self-reversing ball screw or any other type screw drive mechanism either direct driven by a hollow shaft electric motor or indirect by means of a hollow (multiple) shaft gearbox and associated drive(s). Dimensions of the plunger inlet and outlet portion diameters and ball screw drive, roller screw drive or planetary roller screw (pitch or lead, number of starts outside and inside diameter and length) or gearbox type and ratio are a function of required strokes per minute, available torque and revolutions of the drive motor and the required pump maximum discharge pressure and output volume.

Furthermore the hollow drive shaft can be driven by one or more double acting hydraulic or pneumatic cylinders.

For those skilled in the art it can be understood that very long pumping strokes can be achieved with this type of drive mechanism which greatly reduces the number of cycles hence reduces fatigue further and is advantageous for the lifespan of the packing, valves and fluid end body.

Figure 2:
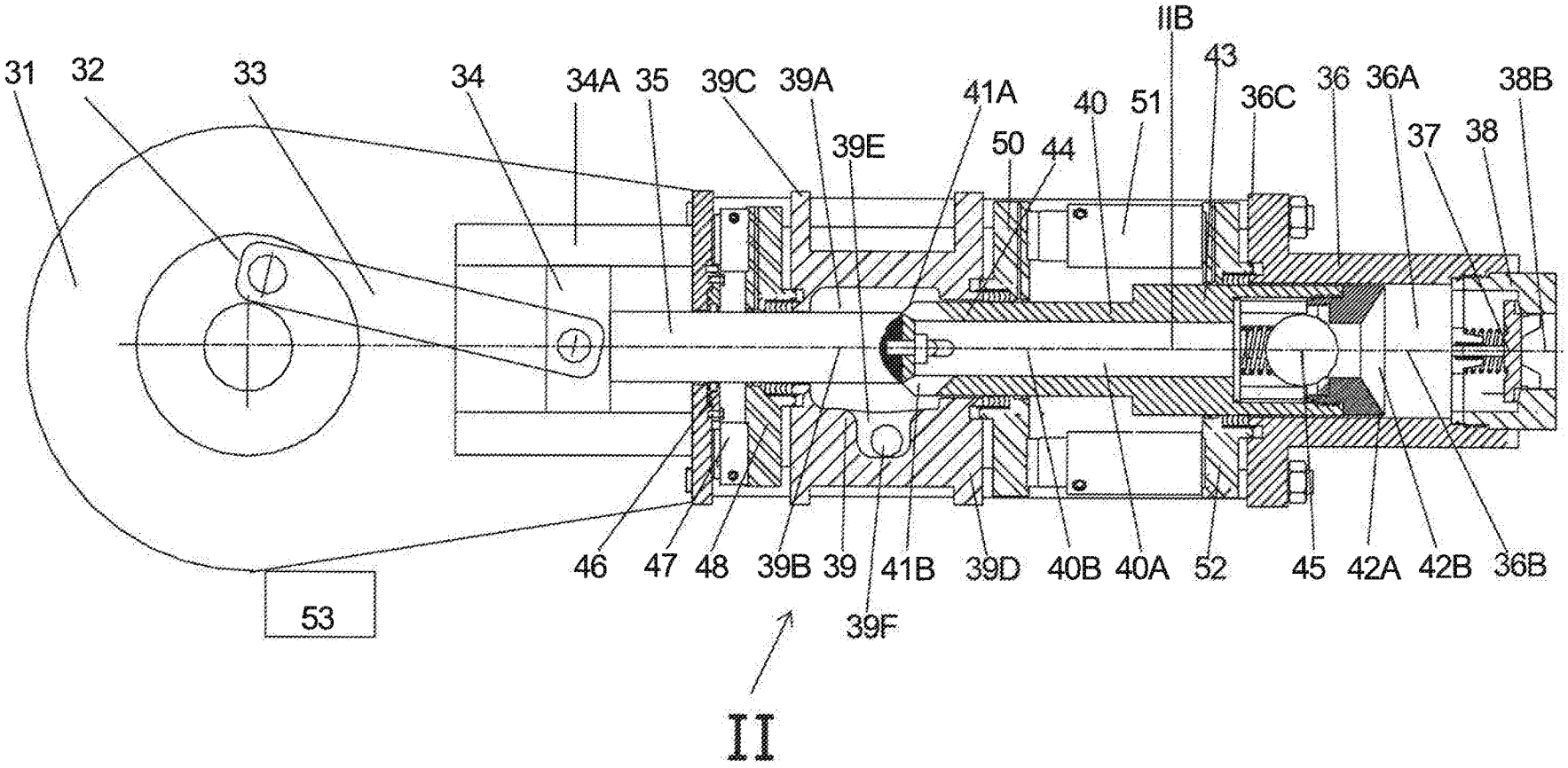
FIG. 2 in cross section schematically shows a second embodiment of a double acting fluid pump in accordance with the invention driven by a crankshaft mechanism.

In FIG. 2 a second embodiment of a double acting positive displacement fluid pump II according to the invention is schematically shown in cross section. In this second embodiment of the double acting positive displacement fluid pump II the pump II is driven by a crankshaft mechanism 31, 32, 33, having a power end 31, a crankshaft 32 and a crankshaft drive rod 33. The crankshaft drive rod 33 is connected to a guide block 34 mounted in a guide sleeve 34A, which guide block 34 is connected to a push/pull rod 35.

The double acting positive displacement fluid pump II has a first housing 36 comprising a cylindrical pump fluid inlet chamber 36A and a second housing 39, separate from the first housing 36, comprising a cylindrical pump fluid outlet chamber 39A. The cylindrical pump fluid outlet chamber 39A comprises a fluid outlet 39E, It can be understood that multiple pump sections can be fitted together as i.e. a Triplex or Quintuplex pump, either constructed as a monobloc or individual pump sections as is common with conventional reciprocating pumps. The flow of multiple pump sections is combined via passage 39F which is under constant fluid pressure. This pressure will assist in the initiation of the discharge strokes of the inlet plunger portions 43 of multiple pump sections as is dictated by the respective crankshaft positions.

The pump fluid inlet chamber 36A is in fluid communication with the pump fluid outlet chamber 39A by means of a reciprocatingly drivable hollow plunger 40 having a through passage 40A. The hollow plunger 40 has an inlet portion 43 positioned within the pump fluid inlet chamber 36A and an outlet portion 44 positioned within the pump fluid outlet chamber 39A. The inlet portion 43 of the hollow plunger has an outside diameter which effective area is larger than the effective area of the outside diameter of the outlet portion 44.

The hollow plunger 40 is further provided with a combined suction-discharge valve 45 arranged in the through passage 40A. The pump fluid inlet chamber 36A comprises a fluid entry 38 having an inlet suction valve assembly 37. Also in this embodiment the central pump fluid inlet chamber axis 36B, the central pump fluid outlet chamber axis 39B, the through passage axis 40B and the fluid entry axis 38B are coaxial and form a central double acting positive displacement fluid pump axis IIB.

In this embodiment the inner diameter of the pump fluid inlet chamber 36A is larger than the inner diameter of the pump fluid outlet chamber 39A with an amount such that in combination with the arrangement/dimensioning of the inlet portion 43 and the outlet portion 44 of the hollow plunger the displacement volume of the inlet portion 43 of the hollow plunger is twice the displacement volume of the outlet portion 44 of the hollow plunger. The hollow plunger 40 comprises beveled plunger ends 41A, 42A in which plunger openings 41B, 42B are provided.

The push/pull rod 35 is attached to the hollow plunger 40 and extends through a power end oil seal 46 arranged in the pump end of the crankshaft mechanism and a packing gland and stuffing box 48 which engages with a second head end 39C of the second housing 39. At least one hydraulic cylinder (or actuator) 47 is positioned between the pump end of the crankshaft mechanism and the packing gland 48 to exert a constant but adjustable force between these two components.

The first housing 36 has a first housing head end 36C and the second housing 39 has a second housing head end 39D between which a hydraulic packing adjustment device 50, 51, 52 is arranged. This hydraulic packing adjustment device comprises at least one hydraulic cylinder 51 which is arranged parallel to the hollow plunger 40, an outlet plunger portion packing gland and stuffing box 50 and an inlet plunger portion packing gland and stuffing box 52. The double acting positive displacement fluid pump II further comprises a controller 53 for controlling the operation of the hollow plunger drive 31, 32, 33 and the operation of the at least one hydraulic cylinder 51 in analogy with the controller of the first embodiment as shown in FIG. 1.

It can be understood that the embodiment as shown in FIG. 2 when used as a retrofit for existing conventional crankshaft power ends, the sizing of the pushrod 35, outlet plunger 40 and inlet plunger 43 and its respective housings can be sized and adapted to meet the power end mechanical properties for drive rod and bearings maximum push and pull loads while still providing the double acting principle of the pump.

In the disclosed embodiment in FIG. 2. the sizing of the plunger is based on the pushrod diameter and the inlet portion diameter giving two variables to dimension the pump i.e. the size of the push/pull rod in order to provide the required strength for push and pull forces and the smaller plunger versus the pushrod for the required flowrate.

In comparison to prior art as in U.S. Pat. No. 8,550,794 where one diameter dictates the size of the opposite diameter and these dimensions are always based on either √(smaller piston^2*2) or √(bigger piston^2/2) (in case there is to be equal output of both cavities) in the disclosed embodiment in FIG. 2. the sizing of the plungers is based on the pushrod diameter and the inlet portion diameter or outlet portion diameter, giving two variables to dimension the pump where substantial more output volume with the same pushrod diameter can be achieved.

Figure 3:
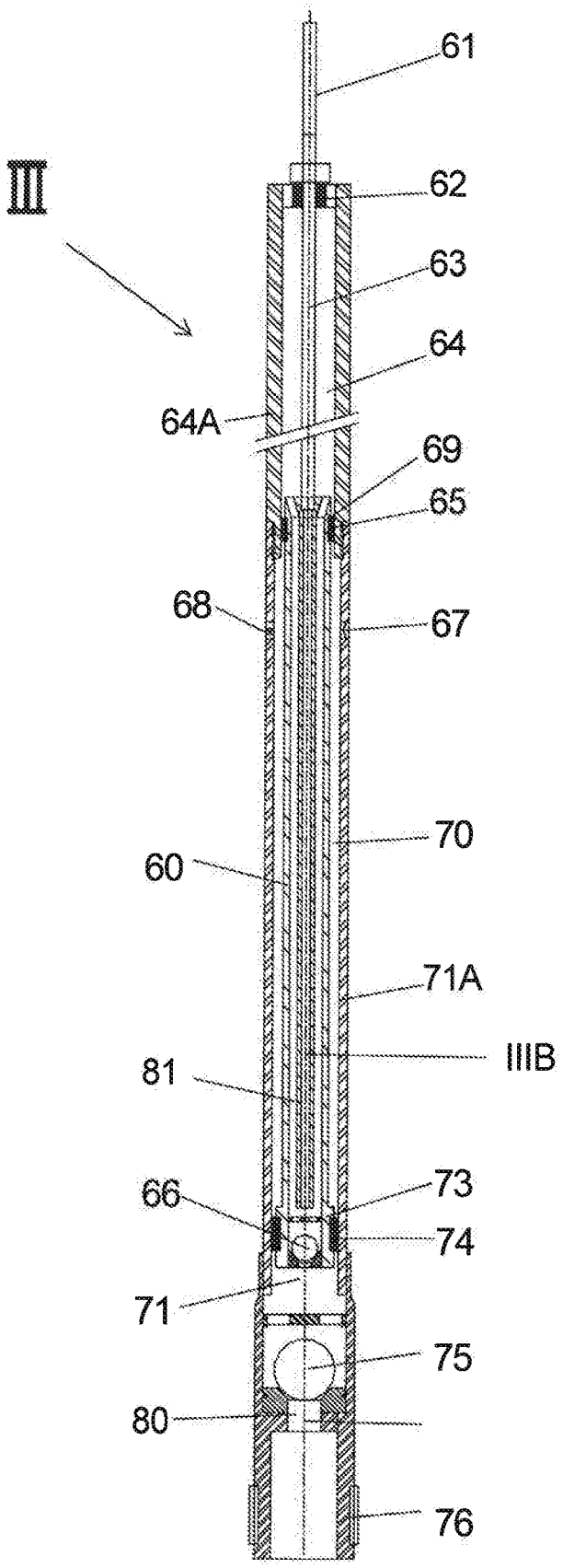
FIG. 3 in cross section schematically shows an embodiment of a double acting fluid pump in accordance with the invention configured as a downhole pump.

FIG. 3 schematically shows a further embodiment of a double acting positive displacement fluid pump III in accordance with the invention configured as a downhole pump. This downhole comprises a lower pump housing 71A and a fluid inlet chamber 71 and an upper pump housing 64A and a fluid outlet chamber 64. The inner diameter of the lower pump housing 71A is larger than the inner diameter of the upper pump housing 64A. The pump fluid inlet chamber 71 is in fluid communication with the pump fluid outlet chamber 64 by means of a reciprocatingly drivable hollow plunger 60 having a through passage. The hollow plunger 60 has an inlet portion 73 positioned within the lower pump housing 71A and an outlet portion 69 positioned within the upper housing 64A. The inlet portion 73 of the hollow plunger has an outside diameter which is larger than the outside diameter of the outlet portion 69 of the hollow plunger. The hollow plunger 60 is further provided with a combined suction-discharge valve 66, also called a travelling valve, arranged in the through passage. The central pump fluid inlet chamber axis, the central axis of the fluid entry 80, the central pump fluid outlet chamber axis and the through passage axis are coaxial and form a central double acting positive displacement fluid pump axis IIIB. The inner diameter of the pump housing 71A is larger than the inner diameter of the pump housing 64A with an amount such that in combination with the arrangement/dimensioning of the inlet portion 73 and packing 74 and the outlet portion 69 and packing 65 of the hollow plunger the displacement volume of the inlet portion 73 of the hollow plunger is preferably twice the displacement volume of the outlet portion 69 of the hollow plunger whereby half of the fluid is displaced up and out of the well and the other half provides fill for the fluid outlet chamber 64. The upward stroke provides the displacement of the fluid out of the outlet chamber 64 and simultaneously providing a suction stroke for the fluid inlet chamber 71. The downhole pump III further comprises a sucker rod 61 to the earth's surface, a guide 62, a polished rod 63, a packing 65 for the smaller outlet portion 69, a pressure relief valve 67, a pressure/vacuum port 68, a pressure/vacuum chamber 70, a packing 74 for the inlet plunger portion 73, a standing or inlet valve 75, a tubing anchor 76 and a volume tube 81 to increase velocity through the hollow plunger.

The piston liner chamber 70 is sealed and closed to the outside in order to prevent the hydrostatic pressure of the well to counteract on pressure effective areas of the outside of the inlet portion 73 and thereby increasing the upward stroke pull forces. It can be beneficial to have the liner chamber 70 pre-charged with air or nitrogen pressure or creating a certain percentage of vacuum inside the chamber 70. During the upward stroke a pressure increase will occur in pressure/vacuum chamber 70. This pressure increase can assist in initiating the downward stroke if so required or in case of a vacuum reduce the amount of pressure increase during the upward stroke. On the upward stroke the force required building up this pressure needs to be taken into account and added to the total upward force. As the pump according to the invention is a positive displacement double acting type pump the downward stroke requires a force to displace the fluid out of the well, in comparison with prior art downhole pumps where the downward stroke does not displace any fluid out of the well. The required downward force is achieved by the weight of the sucker rods which can be sized and adapted as required to achieve the required downward force. The initiation of the downward force will be assisted by the hydrostatic pressure of the fluid column above the outlet portion 69 acting across the effective area of the outlet portion 69 during the pre-compression of the inlet chamber 71 until the pressures above and below the travelling valve 66 are balanced. Furthermore will the achieved pressure in chamber 70 during the upward stroke add additional force to the downward stroke. The length of the hollow piston portion 60 and housing 71A in relation to the length of the pump housing 64A should be determined by the volume of the bigger piston liner chamber 70 and the increase in pressure wanted during the upward stroke. The length of the housing 71A and its related liner chamber 70 in relation to the pump stroke together with the pre-charge pressure or vacuum of the chamber 70 will determine total pressure achieved in chamber 70 at the end of the upward stroke. As the downward stroke is a positive displacement stroke and the compression volume between the standing valve and travelling valve is minimal, gas locking of the pump is minimized.

The double acting positive displacement fluid pump according to the invention can be used in a widespread field, e.g. for pumping well stimulation fluids in fracturing and production enhancement operations in the oil and gas industry; for pumping fluids for high pressure water jetting; for pumping cryogenic fluids; for pumping drilling fluids during drilling operations especially during measuring while drilling and logging while drilling operations; for pumping cement during cementing and plug to abandon operations, well killing, pumping completions fluid; for low to (extreme) high pressure applications in dosing and injection pumps; for high pressure and very low volume injection of chemicals in down hole production flows (such as scale inhibitors and the like); compressing gas; for pumping concrete; and as a submersible down hole pumps for lifting hydrocarbons.

According to another aspect of the invention, which is based on the insight that instead of using a hollow plunger with a through passage for providing fluid communication between the pump fluid inlet chamber and the pump fluid outlet chamber, an external passageway with an integrated one way valve can be used, there is provided a double acting fluid pump having two or more housings comprising a pump fluid inlet chamber and a separate housing comprising a pump fluid outlet chamber, a reciprocatingly drivable plunger, wherein the pump fluid inlet chamber is in fluid communication with the pump fluid outlet chamber by means of an external passage way with an integrated one way valve, said plunger having an inlet portion positioned within the pump fluid inlet chamber and an outlet portion positioned within the pump fluid outlet chamber, the inlet portion of the plunger having an effective displacement area which is larger than the effective displacement area of the outlet portion of the plunger, wherein the pump fluid inlet chamber comprises a central pump fluid inlet chamber axis and a fluid entry having an inlet suction valve assembly, the pump fluid outlet chamber comprises a central pump fluid outlet chamber axis and the plunger comprises a plunger axis, wherein the central pump fluid inlet chamber axis, the central pump fluid outlet chamber axis and the plunger axis are at least substantially coaxial and form a central double acting fluid pump axis. It is then preferred that the dimensioning of the inlet portion and the outlet portion of the plunger is such that the displacement volume of the inlet portion of the plunger is substantially twice the displacement volume of the outlet portion of the plunger. It is then further preferred that the fluid entry of the pump fluid inlet chamber has a fluid entry axis which is coaxial with the central double acting fluid pump axis. It is advantageous when the pump fluid outlet chamber comprises a pressure accumulator and a check valve. Preferably the plunger comprises beveled plunger ends. In an embodiment the housing is composed of a first housing comprising the pump fluid inlet chamber and a second housing, separate from the first housing, said second housing comprising the pump fluid outlet chamber, preferably the pump fluid inlet chamber of the first housing and the pump fluid outlet chamber of the second housing are then cylindrical. In a further embodiment of this aspect of the invention the first housing has a first housing head end and the second housing has a second housing head end, and wherein between the first housing head end and the second housing head end a hydraulic packing adjustment device is arranged, said hydraulic packing adjustment device comprising at least one hydraulic cylinder being arranged parallel to the plunger or wherein between the first housing head end and the second housing head end a mechanical nut type packing adjustment device is arranged. Preferably the double acting fluid pump comprises a plunger drive for reciprocating the plunger, and wherein the double acting fluid pump comprises a controller for controlling the operation of the plunger drive and the operation of at least one hydraulic cylinder.

The invention claimed is:

1. A double acting positive displacement fluid plunger pump having multiple housings, a pump fluid inlet chamber in fluid communication with a pump fluid outlet chamber by a through passage, said through passage being further provided with at least one check valve arranged in the through passage, a reciprocatingly drivable plunger having an inlet portion reciprocatingly positioned within the pump fluid inlet chamber and an outlet portion reciprocatingly positioned within the pump fluid outlet chamber, the inlet portion of the plunger having an outside diameter which is larger than an outside diameter of the outlet portion, wherein the pump fluid inlet chamber and inlet portion comprise a central pump fluid inlet chamber axis and a fluid entry having an inlet suction valve assembly, the pump fluid outlet chamber and outlet portion comprise a central pump fluid outlet chamber axis and a drive shaft comprises a drive shaft axis, wherein the central pump fluid inlet chamber axis, the central pump fluid outlet chamber axis and the drive shaft axis are coaxial and form a central double acting positive displacement fluid plunger pump axis, a displacement volume of the inlet portion of the plunger is larger than a displacement volume of the outlet portion of the plunger, wherein a first housing of the multiple housings comprises the pump fluid inlet chamber and a separate second housing of the multiple housings comprises the pump fluid outlet chamber, and further wherein the pump fluid inlet chamber has a pump fluid inlet chamber wall through which the inlet portion of the plunger extends and the pump fluid outlet chamber has a pump fluid outlet chamber wall through which the outlet portion of the plunger extends, wherein the pump fluid inlet chamber has a stationary inlet plunger sealing arrangement providing a seal between the pump fluid inlet chamber wall and the reciprocating inlet portion of the plunger, wherein the pump fluid outlet chamber has at least one stationary outlet plunger sealing arrangement providing a seal between the pump fluid outlet chamber wall and the reciprocating outlet portion of the plunger, the inlet plunger sealing arrangement being separate from the outlet plunger sealing arrangement, wherein each of the stationary plunger sealing arrangements withstands internal pressure from within to a outside of its respective pump fluid chamber, wherein the first housing of the multiple housings has a first housing head end, the second housing of the multiple housings has a second housing head end and wherein between the first housing bead end and the second housing head end at least one hydraulic packing adjustment device is arranged, said at least one hydraulic packing adjustment device comprising at least one hydraulic cylinder being arranged parallel to the plunger, and the double acting positive displacement fluid plunger pump further comprises a controller for controlling a reciprocating operation of the plunger and an operation of the at least one hydraulic cylinder, wherein the controller monitors and records double acting positive displacement fluid plunger pump parameters.

2. The double acting positive displacement fluid plunger pump according to claim 1, wherein a dimensioning of the inlet portion and the outlet portion of the plunger is such that the displacement volume of the inlet portion of the plunger is twice the displacement volume of the outlet portion of the plunger.

3. The double acting positive displacement fluid plunger pump according to claim 1, wherein a reciprocatingly drivable plunger is a reciprocatingly drivable hollow plunger, said through passage being provided in said reciprocatingly drivable hollow plunger, wherein the pump fluid inlet chamber is in fluid communication with the pump fluid outlet chamber by means of the through passage in the reciprocatingly drivable hollow plunger and with the at least one check valve arranged in the through passage.

4. The double acting positive displacement fluid plunger pump according to claim 3, wherein the hollow plunger comprises beveled plunger ends in which plunger openings are provided.

5. The double acting positive displacement fluid plunger pump according to claim 1, wherein the fluid entry of the pump fluid inlet chamber has a fluid entry axis which is coaxial with the central double acting positive displacement fluid plunger pump axis.

6. The double acting positive displacement fluid plunger pump according to claim 1, wherein a fluid outlet of the pump fluid outlet chamber has a fluid outlet axis which is coaxial with the central double acting positive displacement fluid plunger pump axis.

7. The double acting positive displacement fluid plunger pump according to claim 1, wherein the pump fluid outlet chamber comprises a further check valve and/or a pressure accumulator.

8. The double acting positive displacement fluid plunger pump according to claim 1, wherein the pump fluid inlet chamber of the first housing of the multiple housings and the pump fluid outlet chamber of the second housing of the multiple housings are internally cylindrical.

9. The double acting positive displacement fluid plunger pump according to claim 1, wherein between the housing head ends at least one mechanical nut packing adjustment device is arranged.

* * * * *